United States Patent [19]

Ladt et al.

[11] Patent Number: 4,572,086

[45] Date of Patent: Feb. 25, 1986

[54] FINE FUEL DELIVERY SYSTEM WITH REMOTE DRYING AND ON SITE STORAGE

[75] Inventors: Max A. Ladt; Carroll H. Ladt, both of Paducah, Ky.

[73] Assignee: Convenient Energy, Inc., Paducah, Ky.

[21] Appl. No.: 546,033

[22] Filed: Oct. 27, 1983

[51] Int. Cl.[4] ..... F23D 1/00

[52] U.S. Cl. ..... 110/347; 110/224; 110/232; 110/263; 414/133

[58] Field of Search ..... 110/224, 232, 347, 263; 414/133, 163, 498

[56] References Cited

U.S. PATENT DOCUMENTS

| | | | |
|---|---|---|---|
| 3,229,651 | 1/1966 | Wasp | 110/347 |
| 3,834,568 | 9/1974 | Larson et al. | 414/458 X |
| 4,059,060 | 11/1977 | Gambs et al. | 110/232 |
| 4,084,545 | 4/1978 | Nack et al. | 110/347 |
| 4,373,451 | 2/1983 | Gardner et al. | 110/347 X |
| 4,397,248 | 8/1983 | Mehta et al. | 110/232 |

*Primary Examiner*—Edward G. Favors

*Attorney, Agent, or Firm*—Woodward, Weikart, Emhardt & Naughton

[57] ABSTRACT

A system and method of delivering dried fine fuel. Moist coal is extracted from a source and initially dried to a moisture content of five percent by a gas fired dryer plant. The initially dried fuel is then transported to a central processing site whereat the coal is pulverized and further dried and fed to a storage silo. Tractor-trailers receive the dried fine coal from the storage silo and transport same to the end user's site. The trailer is disconnected from the tractor and is utilized as a storage tank as the coal is withdrawn therefrom on an as-needed basis. A fuel injector coupled to a variable rate feeder is utilized in one embodiment to convey the dried fine fuel from the trailer to the burner.

18 Claims, 6 Drawing Figures

FINE FUEL DELIVERY SYSTEM WITH REMOTE DRYING AND ON SITE STORAGE

BACKGROUND OF THE INVENTION

This invention is in the field of systems for delivery of fuels to be supplied to a burner and more specifically fuel systems for the delivery of fine coal or coke.

Coal, particularly in the United States, offers an abundant, relatively inexpensive, and practical answer to fuel needs. In the past, however, there have been numerous technical, economic and environmental constraints that have prevented the utilization of coal. Most coal mined in the United States is burned by the utility market since the utilities can afford the expensive material handling requirements along with the transportation and environmental protection costs. The industrial market having individual lower requirements for energy as compared to the utilities have been unable to utilize coal due to the cost of the material handling system along with the environmental restrictions and the non-existence of a good delivery system. Heretofore, there has not been an existing method of obtaining convenient, easily stored, processed fuel from coal as compared to either oil or gas.

Disclosed herein is a fine fuel delivery system which is unique in that the fuel delivered is fine coal or coke and is conveniently stored in a ready-to-use condition within delivery containers at the user's site. Once the delivery vehicles or tanks are emptied, the truck tractor hauls away the empty tank and replaces same with a new tank filled with the ready-to-use fuel. Thus, the user is spared the necessity for investing in large capital equipment for storage and possibly even processing of the fuel while at the same time allowing the utilization of considerably less expensive fuel. Such a delivery system is especially convenient to small users of energy such as cement plants, lightweight aggregate operations, asphalt plants, small industrial boilers and similar facilities. The savings resulting from the elimination of the normal coal receiving, storing, processing and recovery equipment is therefore absorbed by the energy supplier who then may amortize the cost thereof over many purchasers achieving the same economies obtained by the aforementioned utility market.

The long term cost of coal is relatively known as compared to alternative fuels. Through the use of coal, smaller users may enter into long term fuel contracts allowing for the projection of costs with some assurance for five to ten years. The use of the delivery system disclosed herein also allows the extraction and use of a large supply of otherwise "waste" materials existing as pond coal or filter cake from preparation plants at attractive prices or other sources of heat energy; such as, newly mined coal, coke, biomass, etc. further providing for the attractiveness of the system.

It is known in Germany to pulverize coal to coal dust and then distribute same to remote users. Typically after pulverizing, the dust is stored in silos which include temperature and gas probes, and, explosion relief flaps. The dust stored in the silos is then transported by truck or railroad car while under an inert gas blanket to the site of the user and subsequently stored in smaller silos and then pumped to the burner as needed. Such a delivery system does not, however, utilize the delivery or transport vehicles for on-site storage. Thus, the user must still invest in the normal coal receiving and storage facilities increasing the direct cost to the user to the point where it is economically unfeasible for relatively small users to avail themselves of such a system.

SUMMARY OF THE INVENTION

One embodiment is a fine fuel delivery system comprising initial drying means located at a source of fuel and operable to receive moist fuel and to initially dry same to a moisture content less than fifteen percent, pulverizing and final drying means located at a site other than at the source of fuel and operable to receive initially dried fuel and to pulverize and final dry same producing dried fine fuel, and transport and storage means operable to receive the dried fine fuel, to transfer same to the site of the end user and to hold and store same at the site of the end user as the dried fine fuel is withdrawn therefrom and fed to a burner.

Another embodiment is a method of providing coal fuel on an as-needed basis to small end users comprising the steps of obtaining coal from a source, drying the coal to a moisture content less than fifteen percent producing initially dried coal, transporting the initially dried coal from the source to a central processing site, pulverizing the initially dried coal at the central processing site, final drying the initially dried coal at the central processing site producing final dried coal, transporting the final dried coal in a trailer to an end user site, and storing the final dried coal in the trailer at the end user site as the final dried coal is withdrawn as needed.

Yet another embodiment of the present invention is a fine fuel delivery system with remote drying and on-site storage comprising an initial drying plant located near a source of fuel and including an inlet feed, a dryer to receive wet fuel from the feed and to dry same to produce initially dried fuel, an outlet to convey the initially dried fuel from the dryer, means to transport the initially dried fuel from the initial drying plant to a pulverizing and final drying plant located remotely from the source, a pulverizing and final drying plant and including a storage silo receiving initially dried fuel, pulverizer and final dry means operable to receive the fuel from the silo and to pulverize and final dry same, a final product storage silo to receive dried fine fuel from the pulverizer and final dry means, and a tractor-trailer fill device connected to the storage silo, a tractor with disconnectable trailer to receive dried fine fuel from the fill device and to transport the dried fine fuel to an end user, parking means at the end user to hold the trailer while the tractor returns to the pulverizing and final drying plant, and conveying means operable to convey dried fine fuel from the trailer when needed at the end user site.

It is an object of the present invention to provide a system for delivery of convenient energy to a user.

A further object of the present invention is to provide a fine fuel delivery system having remote drying of the fuel with on-site storage thereof.

Yet another object of the present invention is to provide a fine coal delivery system utilizing vehicles for the dual purpose of delivery and storage of the fuel.

Another object of the present invention is a fine fuel delivery system comprising pulverizing and final drying means operable to receive fuel and to pulverize and final dry same producing dried fine fuel, and transport and storage means operable to receive the dried fine fuel, to transfer same to the site of the end user and to hold and store same at the site of the end user as the dried fine fuel is withdrawn therefrom and fed to a burner.

A further object of the present invention is a fine fuel delivery system comprising transport and storage means operable to receive dried fine fuel, to transfer same to the site of the end user and to hold and store same at the site of the end user as the dried fine fuel is withdrawn therefrom and fed to a burner.

Related objects and advantages of the present invention will be apparent from the following description.

DESCRIPTION OF THE PREFERRED EMBODIMENT

Figure 1:
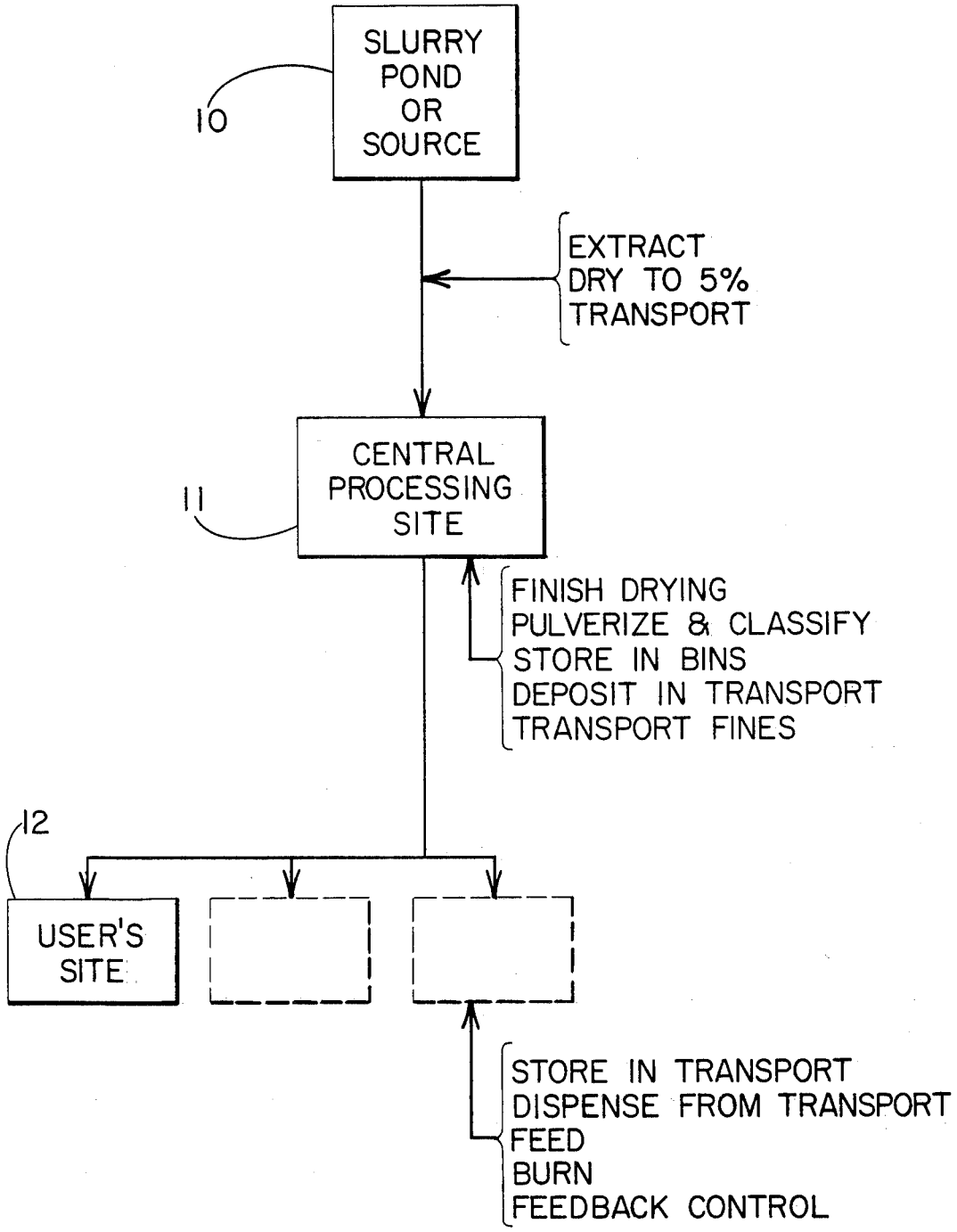
FIG. 1 is a flow diagram of the fuel delivery system incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a block diagram showing the three separate locations for processing and final use of the fuel. The raw material or coal is first extracted from a slurry pond or source 10 and then fed to an initial drying plant wherein the moisture content is reduced to approximately five percent. The dry agglomerated coal is then transported to a final dry and pulverization plant which is located at a central processing site 11 whereat the coal is finished dried, pulverized, classified and stored in bins for subsequent deposit in transport vehicles. The transport vehicles are then used to deliver the final product to multiple users' sites 12 located remotely from site 11. Upon arrival at site 12, the transport tanks are disconnected from the tractors and are used to store the ready-to-use fuel until needed. The fuel is then dispensed from the transport and fed to a burner with the feed rate controlled by means of feedback of pre-determined parameters. The tractor is then used to replace the empty tank with a fresh filled tank.

Figure 2:
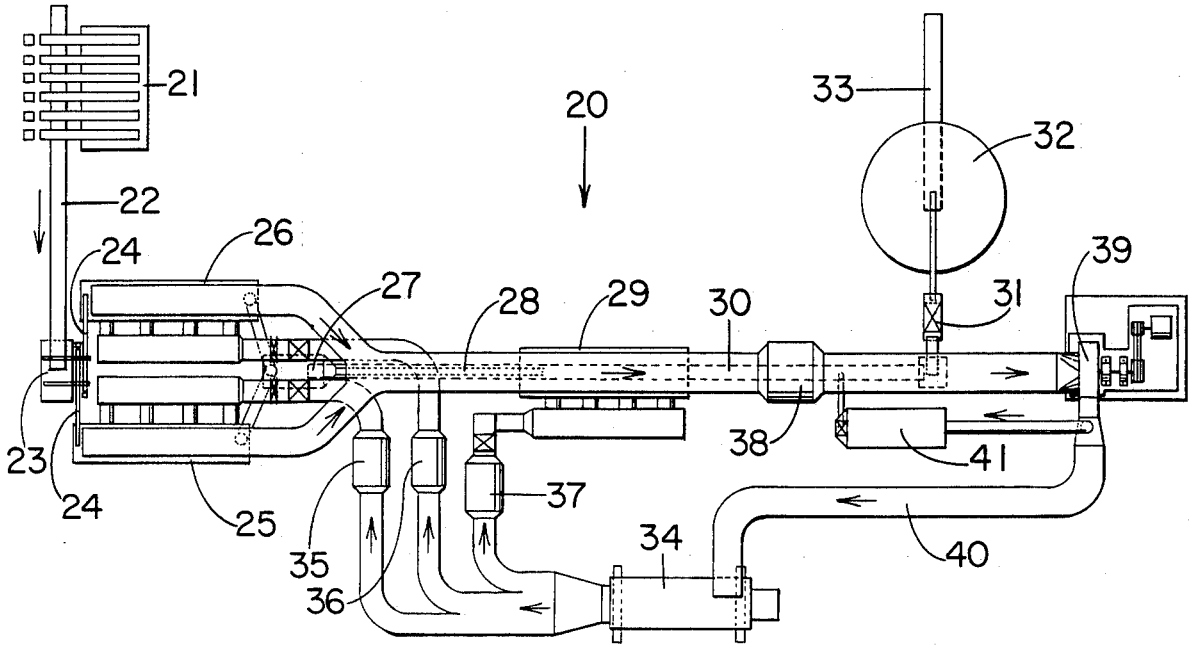
FIG. 2 is a plan view of the initial drying plant.

FIG. 2 depicts a plan view of the initial drying plant 20 located near the slurry pond or source from which the coal is extracted. Plant 20 includes an input in the form of a wet coal feed 21 from which the coal is moved along a conventional belt conveyor 22 emptying into a surge hopper 23. A pair of feed screws 24 carry the coal from hopper 23 to a pair of primary dryers 25 and 26. The agglomerates formed in the primary dryers 25 and 26 are scalped on a screen 27 with the coal then being conveyed by a screw conveyor 28 to a secondary dryer 29 to complete the initial drying process. Screw 28 breaks down the moisture holding agglomerates feeding same to the secondary dryer 29 in turn emptying into a belt conveyor 30 leading to a bucket elevator 31. The dried coal is then stored in silo 32 having an outlet belt conveyor 33 leading to a transport vehicle such as a barge or railroad car.

Burner 34 is operable to blow hot gases through a pair of fly ash separators 35 and 36 respectively exhausting into primary dryers 25 and 26. A third fly ash separator 37 exhausts into the secondary dryer 29 with the exhaust gases exiting a regenerative coal separator 38 and being recirculated to burner 34 by means of main blower 39 and conduit 40. Superfines are collected in the regenerative separator 38 and are either burned in the multi-fuel burner 34, placed on the product belt or a combination of both. In the event burner 34 is fired by gas, then the fly ash collectors may be eliminated between the burner and dryers.

Plant 20 is designed to receive forty tons per hour of thirty percent to twenty percent moisture coal fines and to discharge thirty tons per hour of five percent moisture coal. Typically, the material is under sixty mesh with an expected 250,000 tons per year of product. Control of the plant is by means of a master control panel which fully automates the plant. The panel includes a programmable controller that will both control and monitor all elements of the plant. The surge hopper 23 is equipped with load cells to determine changes in level and automatically modulates the live bottom feeder to maintain a level of approximately fifty percent. The inlet moisture is also monitored and therefore the resultant moisture input is sent to the closed loop burner control which in turn modulates the drying gas temperature to provide a stable output moisture. The plant is essentially an outdoor plant completely insulated with all material conveyors enclosed and with an environmentally controlled centralized control room housing all of the electrical equipment. Parameters measured include both the feed rate and moisture content entering the plant, the moisture content at the discharge along with the temperature and pressure in the dryers. The upstream sensing on the surge hopper 23 allows a five minute buffer giving the system time to anticipate and adjust for changing thermal loads. This arrangement results in an operation that is adaptable to swinging loads, is flexible in the material it can handle, and is not dependent on highly experienced operators to run the system efficiently.

The various components of plant 20 are conventional in nature. The bottom wall is equipped with a series of feed screws discharging to a common screw 24 on each side of the bin. Both common screws feed material at a controlled rate and are driven by DC motors and an SCR controller. Primary control is provided by sensing changing feed rates to the surge hopper which is continuously weighed by load cells on the structural steel frame. Secondary control is provided by sensing the moisture of the material on the infeed conveyor 22. A signal is provided by an I.R. scanner type moisture indicator. Both signals are fed to the programmable controller which then determines the thermal load and adjusts the hot gas temperature. When the burner has responded to the load change, the controller adjusts the feed rate of the SCR driven feeders to return the surge hopper to its normal operating level. This level provides five minutes lead time to the system before the moisture changes at the dryer.

The two primary dryers 25 and 26 consist of two vibrating fluid bed dryers in parallel. The dryers consist of a structural hot gas plenum supporting a drilled stainless steel pan and vibrating motors. The hot gas plenum is insulated to improve thermal efficiency with each unit driven by motors.

The product from dryers 25 and 26 pass through rotary air locks to scalping screen 27 to separate moisture-bearing agglomerates. The low moisture fines pass through to the discharge belt and then feed into a screw conveyor 28 which breaks up the low strength agglomerates and feeds to secondary dryer 29.

Secondary dryer 29 is the same as primary dryers 25 and 26 with the product discharge through a rotary air lock to the discharge belt conveyor that runs under the secondary dryer 29. The moisture level of the combined discharge is monitored by a second I.R. scanner and its signal enables the controller to adjust the set point temperature of the hot gases. The system therefore provides close tolerance on discharge moisture level. Burner 34 mixes the products of combustion with the process gas stream to provide the required temperature. The inner air wall approach introduces air to the combustion chamber in such a fashion that it does not drop the flame temperature immediately but provides a lower temperature for the wall of the chamber protecting the refractory. This approach enables a wide range of operating conditions with temperatures from 450° F. to 1800° F. In the coal fired option, a pulverized coal burner is installed as well as a special refractory. These burners are capable of controlling the flame shape, which permits a more compact heater design and are capable of firing gas and oil as well. The discharge from burner 34 is divided into three fly ash separators 35 through 37. Each separator includes a dump valve fly ash holding hopper which is emptied periodically. Cleaned hot gas from the fly ash separator is ducted into its respective dryer by means of a heavy flanged steel gas ducting, thermal insulation and weather proofing. Each gas stream is controlled by a series of three dampers. There is a plenum damper which is used to regulate gas flow to the individual dryer and to balance the heat load to the three units. Each dryer is equipped with a bypass damper to divert hot gas from the dryer inlet plenum to the dryer exit plenum. This maintains sufficient temperature in the system during start up and shut down conditions to avoid condensation in the return gas duct or the bag house collector 41 connected to conduit 40. Each dryer is equipped with a drop out damper to exhaust hot gas to the atmosphere in case of a system upset. The regenerative coal separator 38 is located in the common exit line downstream of the point where the three dryer outlets emerge. The separator is arranged so that the dump valve on the particulate hopper can discharge either to the product belt or to the inlet of the fine coal feed hopper serving the coal burner.

The discharge gases are withdrawn to maintain a stable moisture load in the system and to remove ultra fine particulates from a discharge system. This coal provides additional product or fuel for the coal fired burner 34. Bag house 41 is designed for high temperature operation up to 350° F. The unit is factory insulated and weather proofed and equipped with supporting steel walkways, platforms and explosion venting. The bag house collector includes a pulse air compressor including its own refrigeration-type dryer, a screw conveyor and air lock to discharge collected fines to the burner feed system or the product belt as required.

The agglomerated fuel is dried to approximately five percent moisture and is transported from plant 20 to the grinding and processing plant. The transportation can be accomplished either by truck, rail, barge or conveyor. The material itself at this stage is relatively easy to handle and entirely non-combustible.

From dryer plant 20, the product is transported to a central processing site 11 such as a river port facility. The product is loaded directly into the finished drying and pulverizing system with the ground and classified material carried overhead by an inert gas stream and deposited in the collectors on the roof of the product bin. The bin is kept under a load of inert gas from the final dryer/grinder system and tank trucks are subsequently loaded by gravity through a loading chute.

Figure 3:
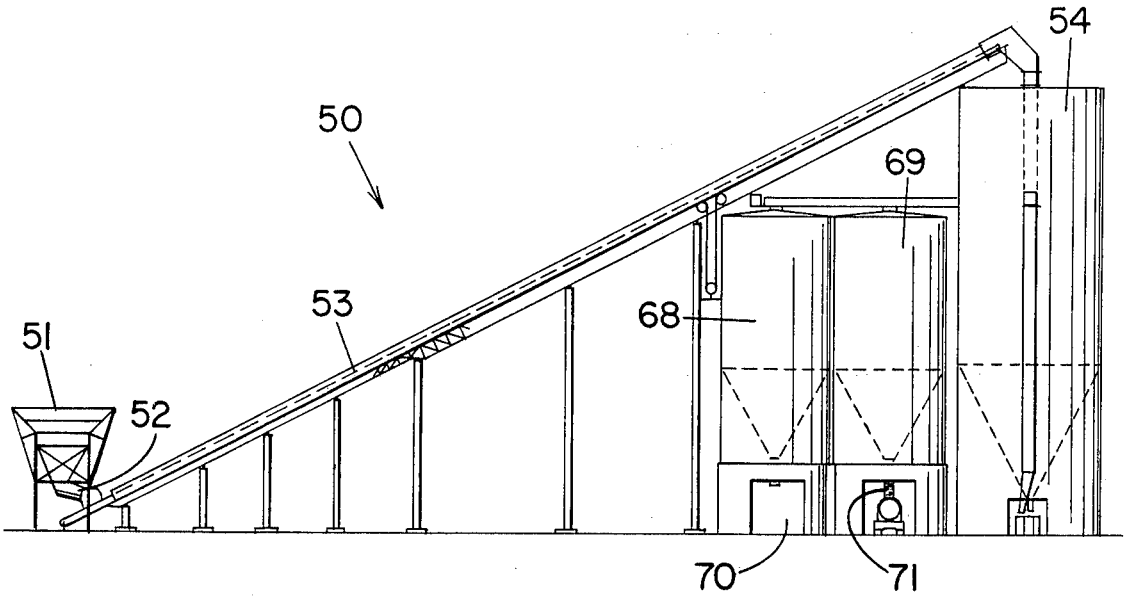
FIG. 3 is a side view of the final drying and pulverizing plant.

A typical final dry and pulverizing plant 50 located at site 11 is shown in FIG. 3. The plant is located near the consumers to minimize handling of finely pulverized coal. The coal is deposited into a receiving hopper 51 and in turn is discharged uniformly from the hopper by means of a vibrating feeder 52 and onto a belt conveyor 53. Conveyor 53 conveys the coal to the top of a silo 54. A magnetic head pulley removes any ferrous contaminants from the material with the contaminants discharged into a tramp iron container on the silo roof. The main material flow will be monitored by a pyrotechnic device coupled to an eighteen inch momentary positioned diverter gate. A slug of material containing a flame or ember is diverted from the flow to a refuse chute and thus to a refuse container. The normal flow of conveyor discharge is into the silo.

Silo discharge is regulated by a rotary valve 55 (FIG. 4) with hazardous material being diverted by a conveyor 56 into the refuse container 57. Normal flow is directed to a second screw conveyor 58 which transports the coal to a pulverizing mill 59 via a rotary feeder. Pulverizing mill 59 pulverizes the coal to approximately eighty percent minus two hundred mesh. A separator 60 above the mill allows only the required material sized to pass and oversized particles are forced back into the mill for further grinding. The pulverizing operation and pneumatic conveying takes place in an inert atmosphere accomplished by firing a portion of the product into a heater unit. The combustion products are oxygen poor. The hot gas further benefits the process by vaporizing any remaining moisture present in the coal. A small blower is provided to inject the inert gas into the storage system.

A fan 61 provides the main propulsion of the material and gas circulation. The stream of recirculated combustion products is introduced into the lower part of the mill and suspends the sized product. The product is conveyed from the classifier via a pipeline 62 to a cyclone separator 63. The product drops out of the air stream into the cyclone hopper 64 with the gas in turn piped back to the main mill fan thereby closing the loop. Water vapor is removed from the system through a fabric collector located next to the cyclone. Any incidental product dust is trapped by the fabric filters. The moist air is pulled through the pulse jet fabric filter and exhausted by a blower into the atmosphere.

Figure 4:
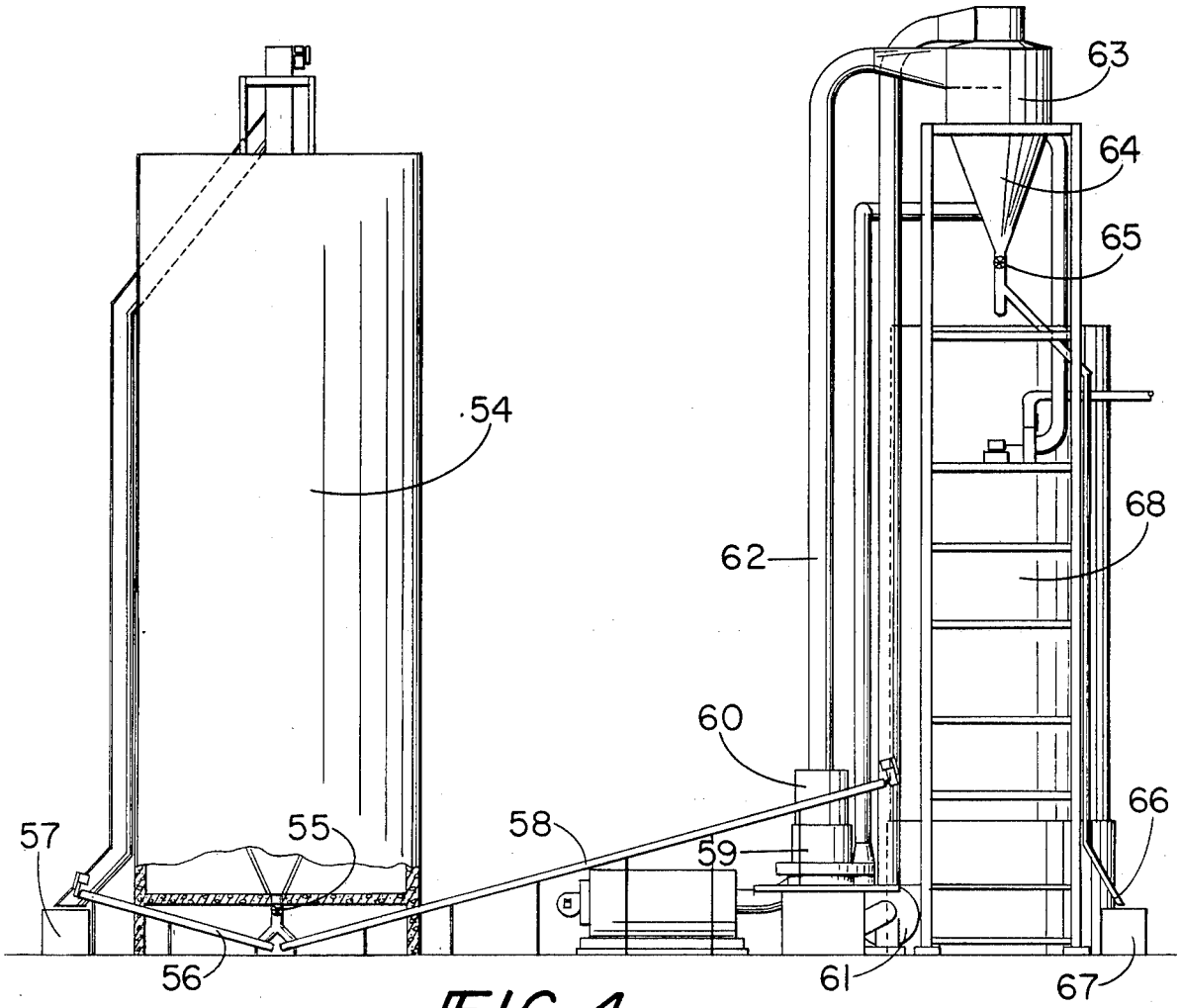
FIG. 4 is side view of the dried coal storage silo, pulverizing mill and product storage silo.

Discharge from both the cyclone and fabric collector is regulated by rotary air locks 65. A pyrotechnic system monitors these discharges and hazardous materials and diverts same into a chute 66 feeding a refuse container 67. The product will normally feed a horizontal screw conveyor. A screw conveyor in turn moves the product to the top of one of two product storage silos 68 and 69 (FIGS. 3 and 4). Selection is obtained by means of a slide gate in the first discharge chute. An open gate allows discharging of the first silo; a closed gate causes the material to proceed on to the second silo.

Each product storage silo 68 and 69 includes a tank trailer truck passage 70 with retractable spouts 71 provided at the bottom of each silo. Inventory control is accomplished by a single truck scale located at the plant entrance utilizing the tare weight method.

The dry and pulverized final product is transported to the user's site by transport trailers which also serve as storage bins for the users thereby simplifying the transportation and storage of the material. The trailers include fire/explosion suppression systems. As the tractor delivers a trailer full of fuel to the user, the trailer is placed on a ramp. The fuel system supply is discharged by conveyor directly onto a feeder which is part of the user's burner/conversion system. As tanks of prepared fuel are delivered, the empty tanks are returned to the processing plant by the same tractor.

Figure 5:
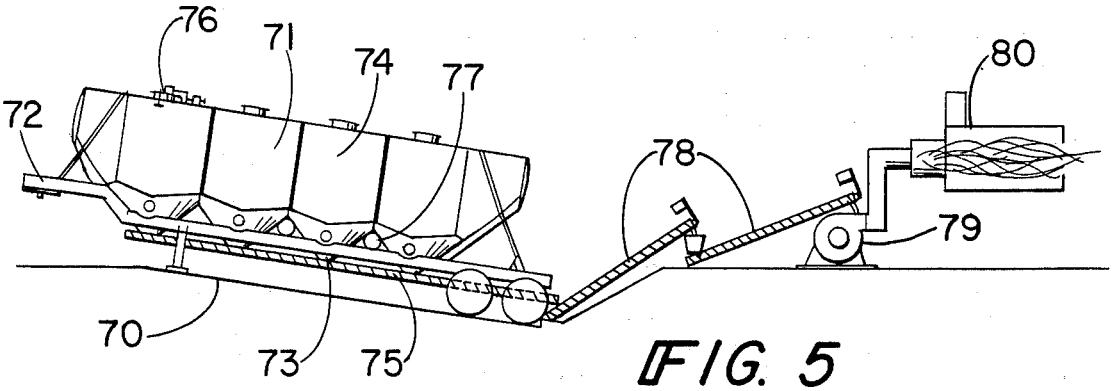
FIG. 5 is a side view of an alternate embodiment of the on-site storage facilities.

The on-site user's facility is shown in FIG. 5 and includes either a horizontal or declined ramp 70 upon which the self-unloading semi-trailer 71 may be rolled onto by a conventional over-the-road tractor. Trailer 71 may be a cement trailer having a conventional coupler 72 for removably attaching to the tractor. A plurality of discharge valves 73 are provided at the bottom of each hopper 74 and are positionable immediately over a screw conveyor 75 secured to the trailer frame. An explosion vent 76 is provided and is set to release and is equipped with counterweights for quick closure after pressure release. A plurality of inert gas bottles 77 are mounted to the trailer frame to provide an inert gas purge blanket system making up for any leakage that may occur after the trailer has been filled and padded by inert gas at the preparation plant.

The on-board inert gas cylinders are located midway along the length of the trailer with the gas piped into the pneumatic unloading system. Once the trailer is loaded to capacity, the hatches are closed and the pressure inside the trailer is increased to about 2–3 psig with inert gas. The on-board inert gas supply is set to come in through a reducing regulator once the pressure in the trailer falls and when the temperature sensors provided in the hoppers indicate a build up of temperature.

In operation, the trailer is filled with prepared fuel at the central processing site to the maximum weight limit of the tractor-trailer combination. The hatches are closed and sealed and nitrogen pressure admitted to the air space over the solid material to a pressure of about 3 psig. The trailer is then towed to the user's facility. Assuming the trailer is to function as a storage vessel, the following procedure is observed:

(1) The driver backs the trailer into position against a stop.

(2) The driver jacks the running gear off the fifth wheel of the tractor and connects the material discharge screw via a flexible sock to a stationary hopper located at the use point. As shown in FIG. 5, a receiving conveyor 78 is positioned at the end of conveyor 75 and is operable to discharge the product via a blower 79 in turn operatively associated with the user's burner 80.

(3) At the same time, the operator connects a portable connection on the trailer to a source of inert gas for protection; to a power supply to operate the screw conveyor and the controls; and to a control circuit which will be tied back to the plant controls to indicate the need to discharge the material, the ability to admit inert gas, the need for admission of inert gas or the indication of a temperature build up.

(4) Once this connection has been made and the system indicates a green light, the driver will hook to the empty trailer, disconnect it from all stationary connections and return it to the central processing plant.

Figure 6:
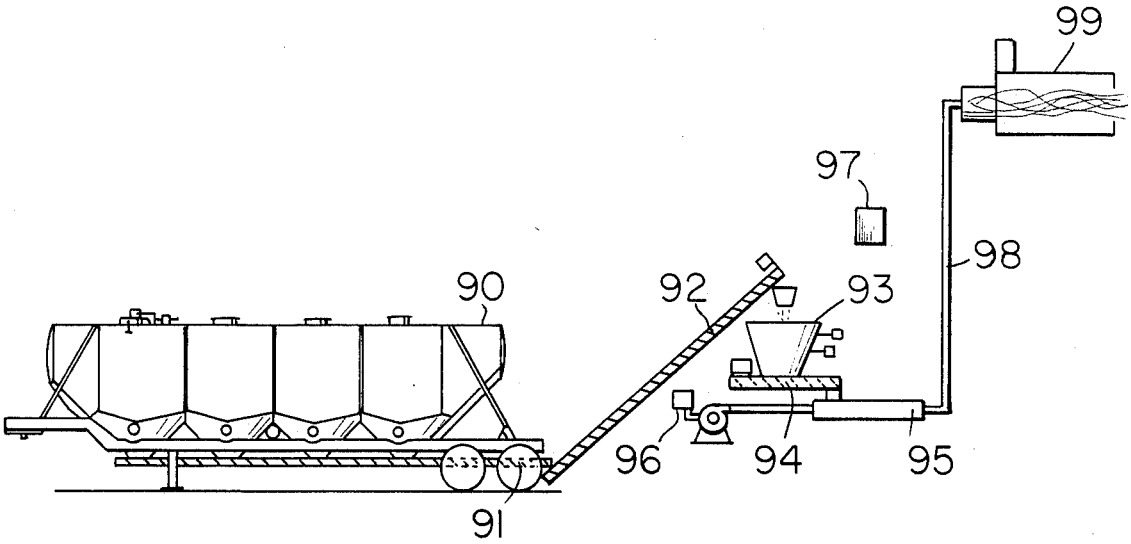
FIG. 6 is a side view of the preferred embodiment of the on-site storage facilities.

FIG. 6 shows the preferred embodiment of the unloading and storage facility at the user's plant. A self-unloading semi-trailer 90 identical to semi-trailer 71 is parked on a horizontal surface and includes discharge valves opening over a screw conveyor 91 secured to the trailer frame. Conveyor 91 empties onto a conveyor system 92 provided at the customer's site. Conveyor system 92 empties into a hopper 93 of a variable rate feeder 94 which in turn empties into a fuel injector 95. The fuel injector is of a venturi design with forced air being provided thereto by blower 96. The solid fuel is forced from ejector 95 into conduits 98 leading to the user's burner 99. A control panel 97 is connected to burner 99 to sense a variety of parameters providing a feedback to control the speed of the variable rate feeder 94. Hopper 93 includes a high and low sensor to control the feed rate of the solid fuel to the hopper. A plurality of semi-trailers 90 may be parked in adjacent relationship and operably connected to conveyor system 92. Thus, as semi-trailer 90 is emptied, the level of fuel within hopper 93 will be sensed thereby signalling the operator and causing semi-trailer 90 to be unconnected from conveyor system 92 which in turn is automatically connected to the adjacent semi-trailer.

Many variations are contemplated and included in the present invention. For example, the initial drying step may be eliminated and instead the fuel may be ground and dried simultaneous with transport means such as a railroad car or barge then being utilized to transport the dried fine fuel to the transport vehicle. Likewise, the grinding plant may be fed with newly mined coal having a low moisture content thereby eliminating the initial drying step with the final drying occurring during the grinding step. Yet another version of the present invention includes drying the fuel without grinding. In lieu of using the truck-trailer vehicle 90 shown in FIG. 6, it is possible to utilize a railroad car having the same characteristics as the trailer including the exit feed. In certain instances, the transport vehicle may be eliminated entirely with a pipe provided from the grinding and drying location to the end user. Such a pipe is connected to a storage silo at the processing location and then extends to the user's feed system connected to the burner.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A fine fuel delivery system comprising:

initial drying means located at a source of fuel and operable to receive moist fuel and to initially dry same to a moisture content less than fifteen percent;

pulverizing and final drying means located at a site other than at said source of fuel and operable to receive initially dried fuel and to pulverize and final dry same producing dried fine fuel; and, transport and storage means operable to receive said dried fine fuel, to transfer same to the site of the end user and to hold and store same at the site of the end user as said dried fine fuel is withdrawn therefrom and fed to a burner.

2. The fine fuel delivery system of claim 1 wherein said transport and storage means includes a trailer removably connectable to a tractor truck with said trailer having a tank with an inlet and an outlet, said tank is sealable to receive an inert gas cover over said dried fine fuel positioned therein.

3. The fine fuel delivery system of claim 2 wherein said trailer includes feed means positioned adjacent said outlet and operable to convey said dried fine fuel falling through said outlet and to convey same away from said tank.

4. The fine fuel delivery system of claim 3 and further comprising ramp means at the site of the end user operable to receive said trailer while said trailer is being emptied as said dried fine fuel is feed to said burner and while said tractor returns to said pulverizing and final drying means to obtain another trailer full of said dried fine fuel.

5. The fine fuel delivery system of claim 4 and further comprising conveyor means extending between said ramp means and said burner to convey said dried fine fuel from said trailer on an as-needed basis.

6. A method of providing coal fuel on an as-needed basis to small end users comprising the steps of:

obtaining coal from a source;

drying said coal to a moisture content less than fifteen percent producing initially dried coal;

transporting said initially dried coal from said source to a central processing site;

pulverizing said initially dried coal at said central processing site;

final drying said initially dried coal at said central processing site producing final dried coal;

transporting said final dried coal in a trailer to an end user site; and, storing said final dried coal in said trailer at said end user site as said final dried coal is withdrawn as needed.

7. The method of claim 6 and further comprising the step of feeding said final dried coal from said trailer to a burner at said end user site.

8. The method of claim 7 and further comprising positioning said trailer on a ramp at said end user site.

9. The method of claim 8 and further comprising providing an inert gas blanket over said final dried coal in said trailer.

10. The method of claim 9 and further comprising transporting said final dried coal to multiple end users located remotely from said central processing site.

11. The method of claim 10 and further comprising the step of uncoupling at said end user's site a tractor attached to a trailer full of final dried coal to a trailer emptied of final dried coal and returning the empty trailer to said central processing site.

12. A fine fuel delivery system with remote drying and on-site storage comprising:

an initial drying plant located near a source of fuel and including an inlet feed, a dryer to receive wet fuel from said feed and to dry same to produce initially dried fuel, an outlet to convey said initially dried fuel from said dryer;

means to transport said initially dried fuel from said initial drying plant to a pulverizing and final drying plant located remotely from said source;

a pulverizing and final drying plant and including a storage silo receiving initially dried fuel, pulverizer and final dry means operable to receive said fuel from said silo and to pulverize and final dry same, a final product storage silo to receive dried fine fuel from said pulverizer and final dry means, and a tractor-trailer fill device connected to said storage silo;

a tractor with disconnectable trailer to receive dried fine fuel from said fill device and to transport said dried fine fuel to an end user;

parking means at said end user to hold said trailer while said tractor returns to said pulverizing and final drying plant; and, conveying means operable to convey dried fine fuel from said trailer when needed at said end user site.

13. The system of claim 12 wherein said trailer includes an inlet and an outlet with feed means positioned adjacent said outlet and operable to convey said dried fine fuel falling through said outlet away from said trailer.

14. The system of claim 13 and further comprising a burner at said end user site to receive dried fine fuel from said conveying means.

15. A fine fuel delivery system comprising:

pulverizing and final drying means located at a remote site away from the user site and operable to receive fuel and to pulverize and final dry same producing dried fine fuel; and, transport and storage means including a vehicle movable on public ways and operable to receive said dried fine fuel at said remote site with said vehicle then carrying and transporting same to the site of the end user and to hold and store same at the site of the end user as said dried fine fuel is withdrawn therefrom and fed to a burner, said vehicle including sealable means for containing a gas over said dried fine fuel contained therein.

16. A fine fuel delivery system comprising:

transport and storage means including a vehicle movable on public ways and operable to receive said dried fine fuel at a remote site and to carry and transport same to the site of the end user and to hold and store same at the site of the end user as said dried fine fuel is withdrawn therefrom and fed to a burner, said vehicle including sealable means for containing a gas over said dried fine fuel contained therein.

17. The fine fuel delivery system of claim 16 and further comprising:

a fuel injector positioned between said transport and storage means and said burner and operable to receive said dried fine fuel and controllably feed same to said burner.

18. The fine fuel delivery system of claim 17 and further comprising:

a variable rate feeder positioned between said transport and storage means and said fuel injector, said fuel injector includes an air blower operable to force dried fine fuel through said injector.

* * * * *